US009719205B2

(12) United States Patent
Kasapoglu et al.

(10) Patent No.: US 9,719,205 B2
(45) Date of Patent: Aug. 1, 2017

(54) HEAT PUMP LAUNDRY DRYER WITH NOISE ATTENUATION STRUCTURE

(71) Applicant: ARCELIK ANONIM SIRKETI, Istanbul (TR)

(72) Inventors: Serkan Kasapoglu, Istanbul (TR); Veysel Ertan Cetinkaya, Istanbul (TR); Dogan Demirhan, Istanbul (TR); Can Sar, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 14/781,026

(22) PCT Filed: Mar. 26, 2013

(86) PCT No.: PCT/EP2013/056385
§ 371 (c)(1),
(2) Date: Sep. 28, 2015

(87) PCT Pub. No.: WO2014/154251
PCT Pub. Date: Oct. 2, 2014

(65) Prior Publication Data
US 2016/0053426 A1 Feb. 25, 2016

(51) Int. Cl.
*D06F 58/12* (2006.01)
*D06F 58/20* (2006.01)
(Continued)

(52) U.S. Cl.
CPC ..... *D06F 58/206* (2013.01); *D06F 58/20* (2013.01); *F04D 19/002* (2013.01); *F04D 29/664* (2013.01)

(58) Field of Classification Search
CPC ..... D06F 58/00; D06F 58/12; D06F 58/20; D06F 58/206; F26B 19/00; F26B 21/00;
(Continued)

(56) References Cited

U.S. PATENT DOCUMENTS 2,028,985 A * 1/1936 Mahon ..... F04D 29/646 415/119
2,089,492 A * 8/1937 Lambert ..... F16L 9/21 138/144
(Continued)

FOREIGN PATENT DOCUMENTS

BE EP 1865103 A1 * 12/2007 ..... D06F 58/04
CN 201258401 Y 6/2009
(Continued)

OTHER PUBLICATIONS

International Search Report and Written Opinion of WO/2014/154251 and references cited therein.

*Primary Examiner* — Stephen M Gravini
(74) *Attorney, Agent, or Firm* — Kilpatrick Townsend & Stockton LLP

(57) ABSTRACT

The present invention relates to a laundry dryer (1) comprising a drum wherein the laundry to be dried is placed, a compressor (3) providing refrigerant cycle, an intake air fan assembly in communication with ambient air and blowing the same over the compressor (3) in order for limiting maximum operational temperature of said compressor (3). Said intake air fan assembly comprises a fan (5) and a fan cover (2) provided within a plastic frame (6) of the laundry dryer (1). The fan cover (2) functioning as an air exchange and noise attenuation structure in between outside environment and the fan (5).

9 Claims, 6 Drawing Sheets

Figure 1:
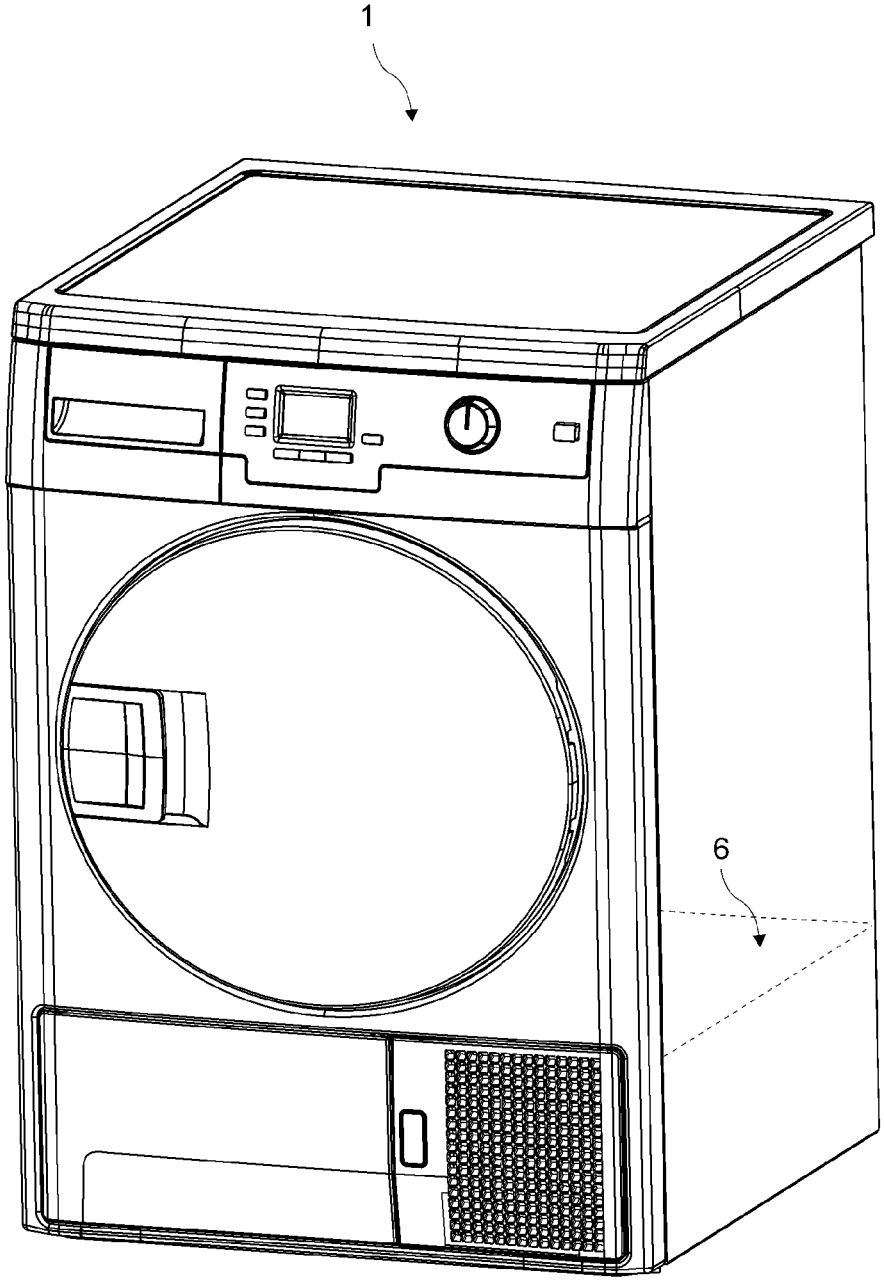

(51) Int. Cl.
*F04D 29/66* (2006.01)
*F04D 19/00* (2006.01)

(58) Field of Classification Search
CPC ..... F26B 21/06; F04D 29/664; F04D 29/663; F04D 29/668
USPC ..... 34/595, 606, 610, 86; 68/19, 20; 8/149, 8/159; 415/119
See application file for complete search history.

(56) References Cited

U.S. PATENT DOCUMENTS 3,736,812 A * 6/1973 Wellauer ..... F16H 57/0493 165/104.34
3,947,148 A * 3/1976 Holt ..... F04D 29/526 181/225
4,489,507 A 12/1984 Kawai
5,236,580 A * 8/1993 Kelleher ..... D06F 43/081 202/181
6,454,527 B2 * 9/2002 Nishiyama ..... F01P 11/12 264/51
6,896,095 B2 * 5/2005 Shah ..... F01P 5/06 181/198
7,367,134 B2 * 5/2008 Osvatic ..... D06F 58/20 137/514
7,409,776 B2 * 8/2008 Ono ..... D06F 58/206 34/606
7,475,495 B2 * 1/2009 Chiles ..... D06F 58/28 219/213
7,526,879 B2 * 5/2009 Bae ..... D06F 58/206 34/239
7,895,771 B2 * 3/2011 Prajescu ..... D06F 58/04 138/114
7,921,578 B2 * 4/2011 McAllister ..... D06F 35/00 134/10
8,113,766 B2 * 2/2012 Chang ..... F04D 25/0613 415/119
8,240,064 B2 * 8/2012 Steffens ..... D06F 58/22 34/210
8,667,702 B2 * 3/2014 Ediger ..... D06F 58/28 165/58
8,707,581 B2 * 4/2014 Quaroni ..... D06F 39/12 34/604
8,899,378 B2 * 12/2014 Wood ..... F04B 23/10 181/229
9,299,332 B2 * 3/2016 Je ..... G10K 11/002
9,359,705 B2 * 6/2016 Nishimura ..... D06F 33/02
2003/0019253 A1 * 1/2003 Lorenz ..... D06F 39/003 68/13 R
2005/0198851 A1 * 9/2005 Tomochika ..... D06F 58/206 34/74
2007/0163094 A1 * 7/2007 Wright ..... D06F 58/203 28/100
2009/0038175 A1 * 2/2009 Ziemann ..... D06F 39/12 34/218
2012/0247158 A1 * 10/2012 Ditze ..... D06F 33/02 68/17 R
2013/0091727 A1 * 4/2013 Yoo ..... D06F 58/28 34/427
2014/0366397 A1 * 12/2014 Wakizaka ..... D06F 58/206 34/524
2015/0368852 A1 * 12/2015 Rockwell ..... D06F 58/04 34/602
2016/0053426 A1 * 2/2016 Kasapoglu ..... D06F 58/20 34/86

FOREIGN PATENT DOCUMENTS

EP 1524360 A1 4/2005
EP 1865103 A1 12/2007
EP 2 395 146 * 12/2011
GB 2109520 A 6/1983
GB 2263502 A 7/1993
JP S5937994 A 3/1984
JP H11300096 A 11/1999
JP 2007/143720 A 6/2007
TR WO 2014154251 A1 * 10/2014 ..... D06F 58/20
WO 2012/089705 A1 7/2012

* cited by examiner

HEAT PUMP LAUNDRY DRYER WITH NOISE ATTENUATION STRUCTURE

The present invention relates to a heat pump laundry dryer having a noise attenuation structure by way of utilizing an enhanced fan cover.

A heat pump laundry dryer typically has a closed cycle drying process. The heat pump used for drying the laundry is composed of the compressor that moves the refrigerant fluid and heat sinks named as evaporator and condenser. It comprises flow tubes through which the refrigerant circulates, a compressor that provides the circulation of the refrigerant by pressurizing it.

The laundry-drying process is performed by passing hot and dry air over the laundry. The condenser disposed in the heat pump functions as a heater and the evaporator functions as a condenser. Humid air leaving the laundry leaves its moisture while passing over the evaporator that works as the condenser and warms while passing over the condenser that works as the heater. Therefore, the process air is heated while passing from the condenser, delivered onto the laundry as being heated and after dehumidifying the laundry, leaves its humidity while passing over the evaporator.

The evaporator is composed of a refrigerant tube in serpentine form and fins arranged on the refrigerant tube. In the cycle wherein the refrigerant circulates in the flow tubes, the refrigerant that is delivered from the compressor to the condenser with increased pressure and temperature enters the evaporator by passing through the capillary tube with decreased pressure. As the compressor's mechanical components are needed to be cooled down to avoid them reaching critical temperature values, an intake air fan is conventionally provided to suck ambient air in order for blowing it over the compressor.

A prior art publication in the technical field of the present invention may be referred to as CN201258401 among others, the document disclosing a laundry dryer for drying laundry with a heat pump system. The heat pump system of the document is provides a bypass air port arranged on an air outlet passage in front of a fan inlet.

The heat pump laundry dryer according to the present invention features an improved noise attenuation performance intake air fan with the help of an acoustic absorption means providing silent running of the heat pump laundry dryer.

The present invention therefore provides an arrangement as to the installation of an acoustic absorption means within a fan cover, which is defined by the characterizing features as defined in Claim 1.

Primary object of the present invention is hence to provide an improved noise attenuation performance intake air fan in terms of noise reduction in a heat pump laundry dryer.

The present invention proposes a heat pump laundry dryer with a compressor, typically providing refrigerant cycle. An intake air fan assembly accordingly communicates with ambient air and cools the compressor down for limiting its operational temperature. Said intake air fan assembly has a fan and a fan cover, said fan cover being securable to a plastic frame portion of the laundry dryer.

Said fan cover has a slot around a cylindrical lateral surface along the center of which extends the longitudinal fan axis. Said slot is delimited by an outer surface extending in parallel with the cylindrical lateral surface. Said cylindrical lateral surface extends parallel to the axial direction of the fan. An acoustic absorption means covers the lateral surface and fits into the slot defined within the outer surface. Said acoustic absorption means is a made of a felt material.

A perforated plate member is provided to cover the open end of the fan cover between the fan and the outside environment such that communication of said fan with ambient air is realized by means of the perforated plate member alone. This eliminates vortexes in this region and ensures homogenous air flow, which may affect overall noise performance.

Accompanying drawings are given solely for the purpose of exemplifying an improved noise attenuation performance intake air fan in a heat pump laundry dryer, whose advantages over prior art were outlined above and will be explained in brief hereinafter.

The drawings are not meant to delimit the scope of protection as identified in the claims nor should they be referred to alone in an effort to interpret the scope identified in said claims without recourse to the technical disclosure in the description of the present invention.

FIG. 1 demonstrates a general perspective view of the laundry dryer according to the present invention.

Figure 2:
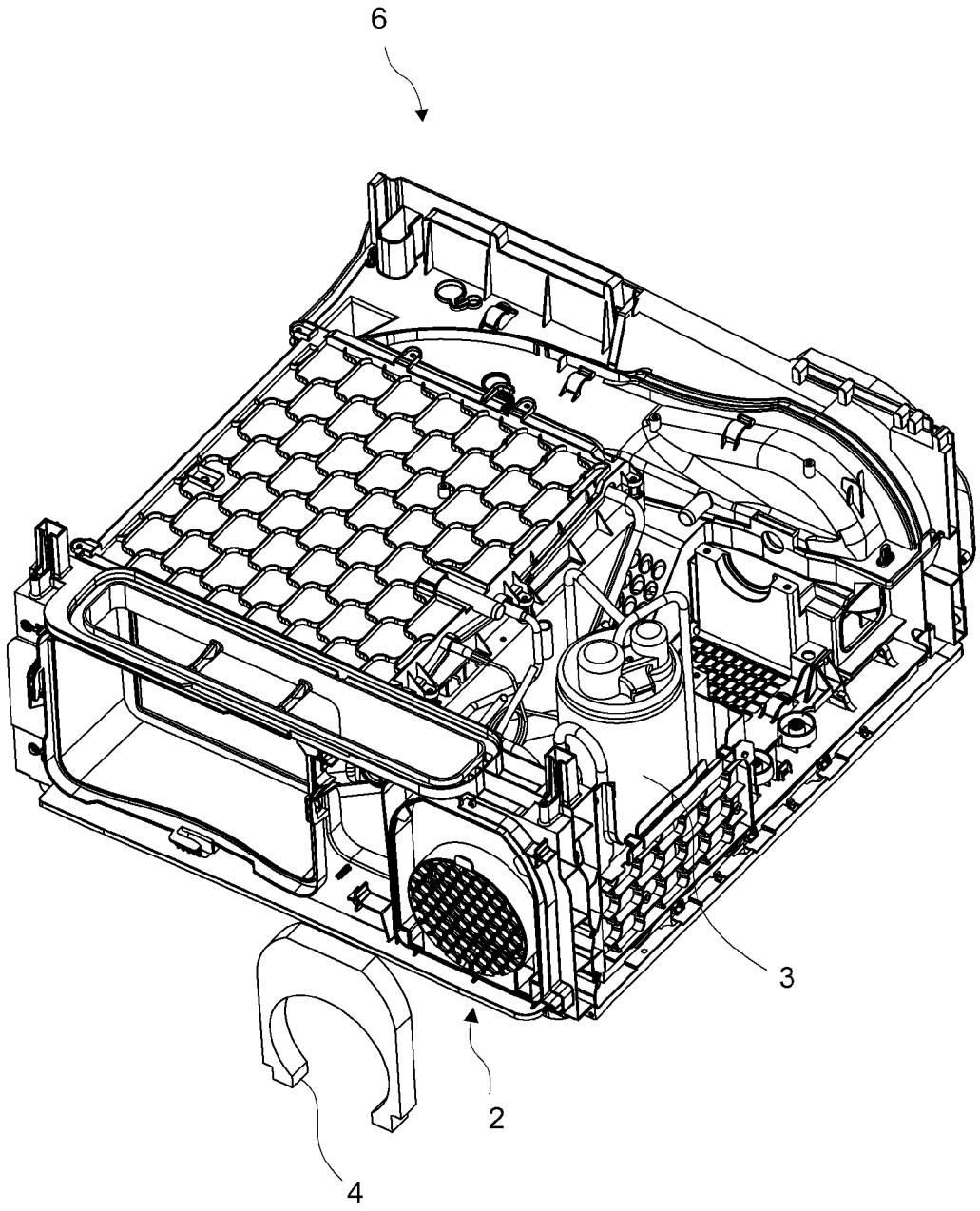

FIG. 2 demonstrates a perspective view of the plastic frame portion of the laundry dryer in which the heat pump components are placed according to the present invention.

Figure 3:
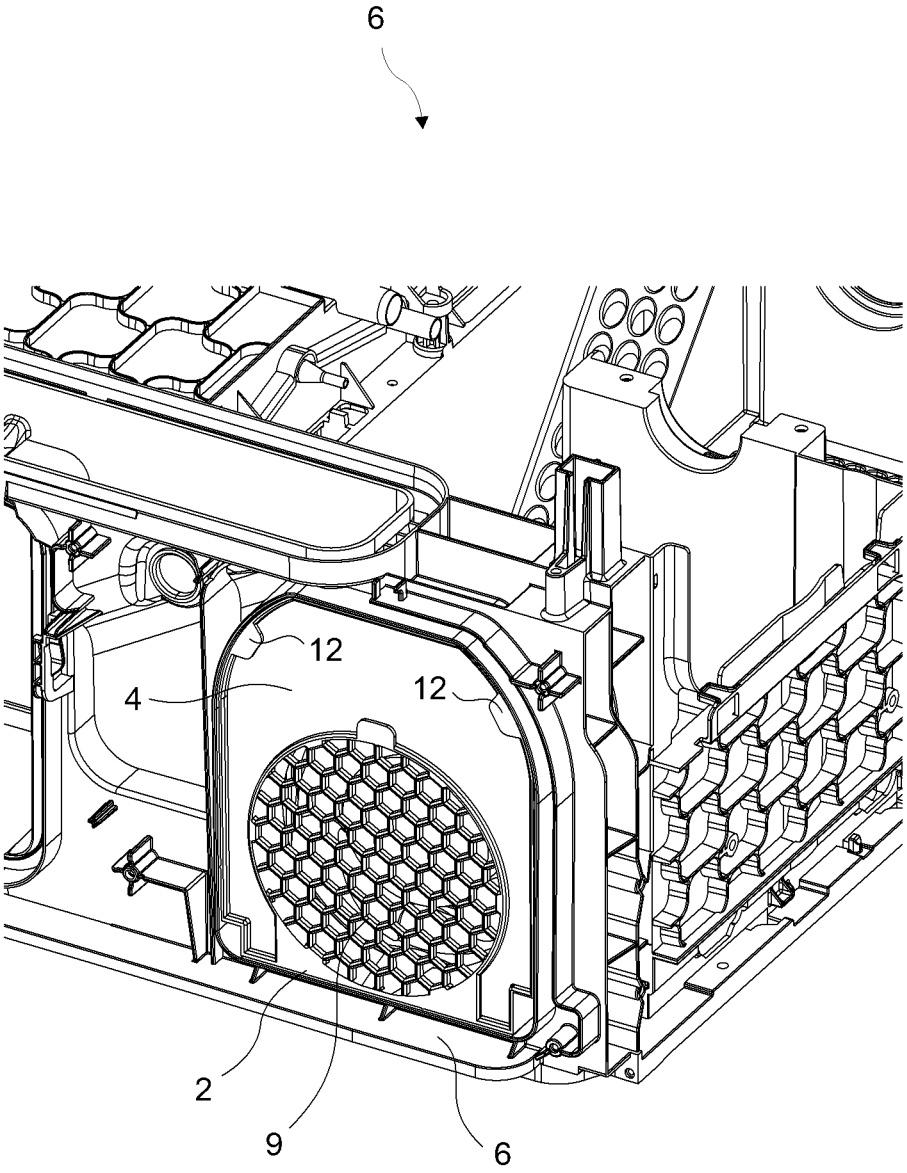

FIG. 3 demonstrates a perspective view of the fan cover according to the present invention.

Figure 4:
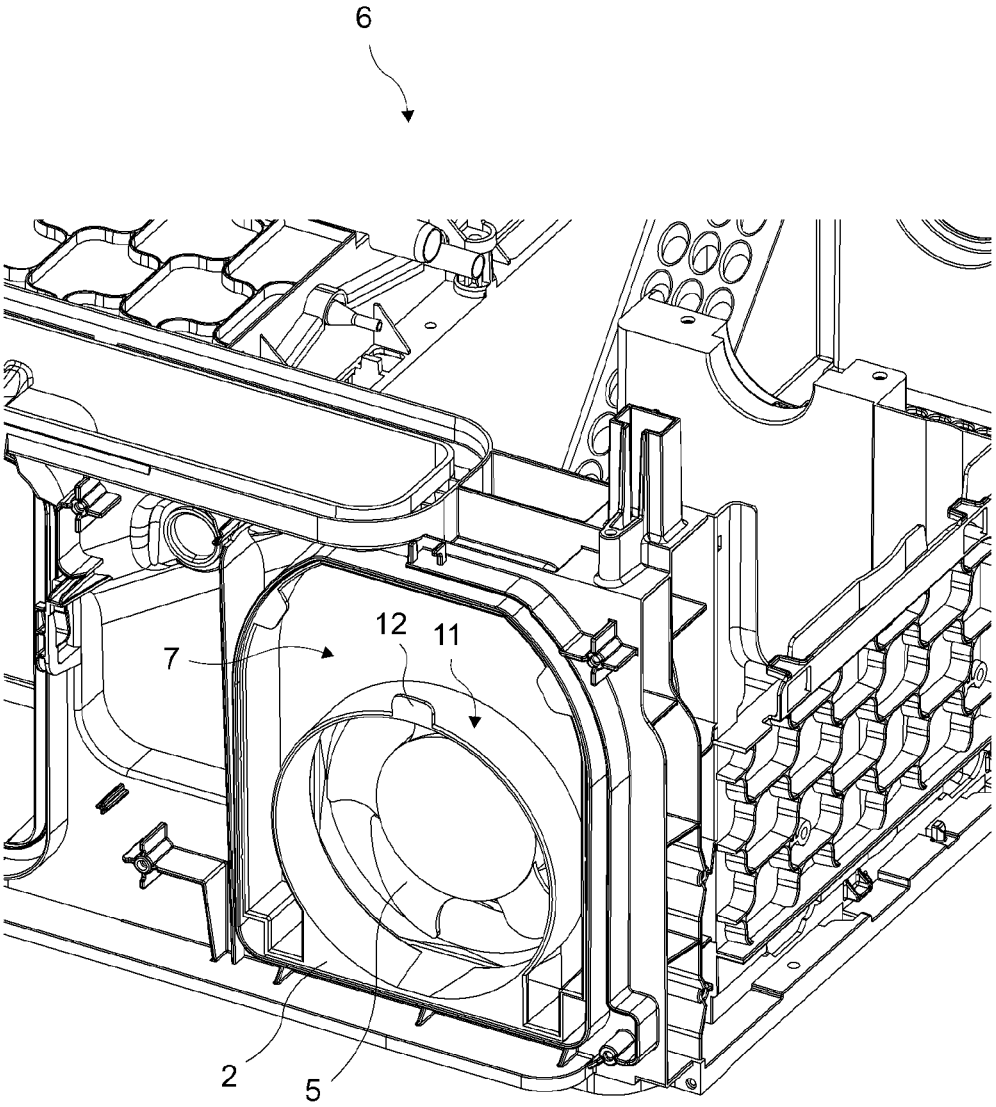

FIG. 4 demonstrates a perspective view of the fan cover without the perforated plate member according to the present invention.

Figure 5:
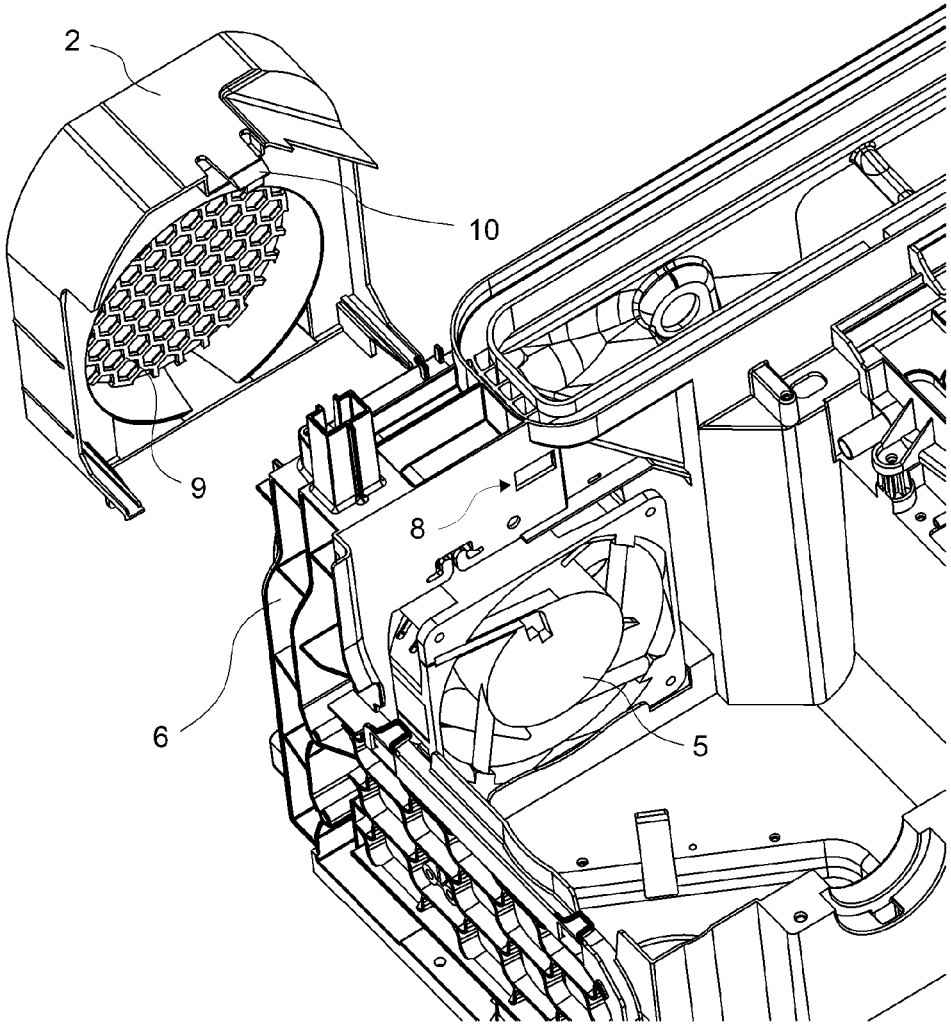

FIG. 5 demonstrates a perspective view of the fan cover in disassembled manner according to the present invention.

Figure 6:
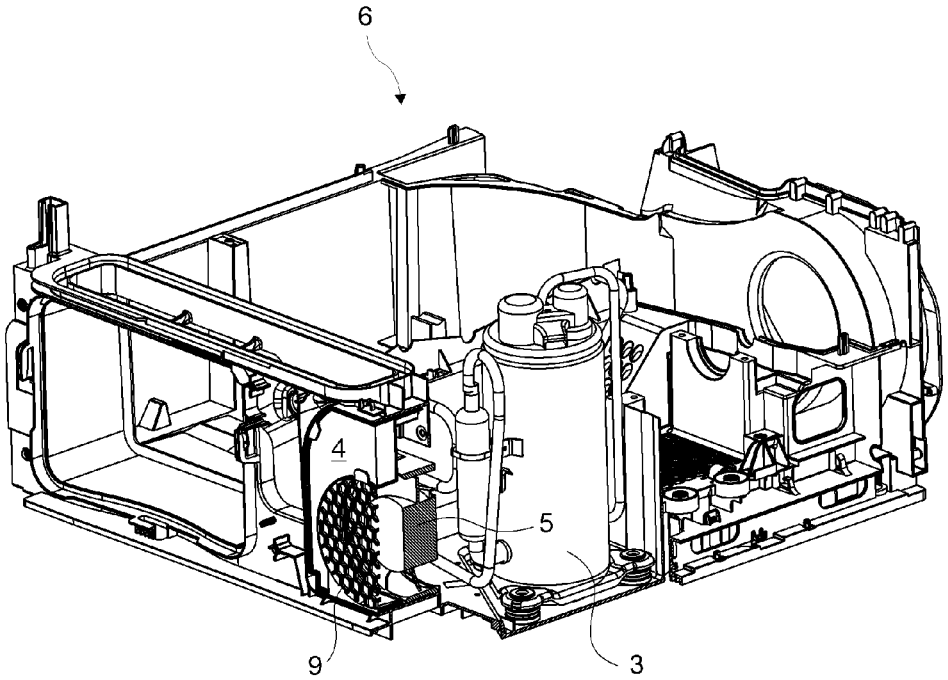

FIG. 6 demonstrates a cross-sectional cut-away view of the fan cover along a vertical surface, i.e. a surface perpendicular to the base of the laundry dryer being in parallel with the longitudinal axis of the fan according to the present invention.

The following numerals are used in this detailed description:

Laundry dryer (1)
Fan cover (2)
Compressor (3)
Acoustic absorption means (4)
Fan (5)
Plastic frame (6)
Recess (7)
Catch slot (8)
Perforated plate member (9)
Mounting catch (10)
Lateral surface (11)
Protrusion (12)

The present invention relates to a laundry dryer (1) comprising a drum wherein the laundry to be dried is placed and a compressor (3) providing refrigerant cycle in a conventional manner. The compressor (3) typically moves the refrigerant fluid and heat sinks named as evaporator and condenser disposed in the heat pump respectively function as a condenser and a heater for processing air.

According to the present invention, an intake air fan assembly is provided to cool down the compressor (3) whose operation is prone to temperature rise and which needs to be cooled down continuously in this respect. Said intake air fan assembly is typically in communication with ambient air and blows air over the compressor (3) in order for limiting maximum operational temperature thereof.

Said intake air fan assembly comprises a fan (5) and a fan cover (2) provided within a plastic frame (6) portion of said laundry dryer (1). Said fan cover (2) defines a recess (7) with a cylindrical lateral surface (11) extending in parallel with the longitudinal axis of said fan (5). The lateral surface (11)

is at least partially covered by an acoustic absorption means (4) extending radially out from said lateral surface (11). The acoustic absorption means (4) is functional in reducing noise generated by a plurality of noise sources such as the fan (5) itself, the compressor (3) due to its internal mechanics and the pressure of the refrigerant fluid and the motor rotating the drum.

In an embodiment of the present invention, the acoustic absorption means (4) is a felt-based material fixedly disposed on the lateral surface (11) and is held in place by at least one protrusion (12) of the fan cover (2).

In another embodiment of the present invention, a perforated plate member (9) is affixed to the outer edge of the lateral surface (11) such that communication of said fan (5) with ambient air is realized by means of the perforated plate member (9) alone. Use of said perforated plate member (9) is advantageous in that it ensures that air is passed over the compressor (3) in a more homogenous manner, i.e. without involving air vortexes that may cause noise performance issues in that region.

In another embodiment of the present invention, the fan cover (2) is securable to the plastic frame (6) by way of at least one mounting catch (10) engaging with at least one catch slot (8) of the plastic frame (6). A plurality of mounting catches (10) or click-and-pawls are provided on the fan cover (2) for this purpose.

The present invention provides an arrangement as to the installation of an acoustic absorption means (4) within a fan cover (2), which is defined by the characterizing features as defined in Claim 1. The acoustic absorption means (4) is functional in reducing noise generated and said perforated plate member (9) is advantageous in that it eliminates vortexes in the region and ensures homogenous air flow.

The invention claimed is:

1. A laundry dryer comprising:

a drum wherein a load of laundry to be dried is placed;

a compressor providing refrigerant cycle; and an intake air fan assembly in communication with ambient air, wherein the intake air fan assembly is configured to blow the ambient air over the compressor in order to limit maximum operational temperature of said compressor, said intake air fan assembly comprising:

a fan; and a fan cover provided within plastic frame of said laundry dryer, wherein said fan cover defines a recess with a cylindrical lateral surface extending in parallel with a longitudinal axis of the fan, and wherein the cylindrical lateral surface is at least partially covered by an acoustic absorption means extending radially out from said cylindrical lateral surface.

2. A laundry dryer as in claim 1, wherein the acoustic absorption means is a felt material fixedly disposed on the lateral surface.

3. A laundry dryer as in claim 2, wherein the acoustic absorption means is held in place by at least one protrusion of the fan cover.

4. A laundry dryer as in claim 1, wherein a perforated plate member is affixed to outer edge of the lateral surface such that communication of the fan with ambient air is realized by means of the perforated plate member alone.

5. A laundry dryer as in claim 1, wherein the fan cover is securable to the plastic frame by way of its at least one mounting catch engaging with at least one catch slot of the plastic frame.

6. A laundry dryer as in claim 1, wherein the acoustic absorption means is disposed within the slot extending between the lateral surface and an outer surface parallel to said lateral surface, said outer surface defining outermost portion of said fan cover.

7. A laundry dryer as in claim 2, wherein a perforated plate member is affixed to outer edge of the lateral surface such that communication of the fan with ambient air is realized by means of the perforated plate member alone.

8. A laundry dryer as in claim 2, wherein the fan cover is securable to the plastic frame by way of its at least one mounting catch engaging with at least one catch slot of the plastic frame.

9. A laundry dryer as in claim 2, wherein the acoustic absorption means is disposed within the slot extending between the lateral surface and an outer surface parallel to said lateral surface, said outer surface defining outermost portion of said fan cover.

* * * * *